US005177404A

United States Patent [19]

Cohen et al.

[11] Patent Number: 5,177,404

[45] Date of Patent: Jan. 5, 1993

[54] REMOVABLE POWER SERVICE MODULE FOR RECESSED LIGHTING SYSTEM

[75] Inventors: Howard G. Cohen, N. Miami Beach, Fla.; Ludwig Gabrecht, Wickede; Helmuth K. Unger, Menden-Halingen, both of Fed. Rep. of Germany

[73] Assignees: Wila Leuchten GmbH, Iserlohn, Fed. Rep. of Germany; Poulsen Lighting, Inc., Miami, Fla.

[21] Appl. No.: 714,880

[22] Filed: Jun. 13, 1991

[51] Int. Cl.[5] ..... H05B 37/02

[52] U.S. Cl. ..... 315/154; 315/314; 315/315; 315/320; 362/364; 362/221; 362/226

[58] Field of Search ..... 315/153, 154, 137, 362, 315/363, 317, 320, 312, 313, 317, 314, 151; 362/221, 226, 364, 365

[56] References Cited

U.S. PATENT DOCUMENTS 4,701,669 10/1987 Head et al. ..... 315/151
4,922,393 5/1990 McNair ..... 362/364

FOREIGN PATENT DOCUMENTS 3129689 2/1983 Fed. Rep. of Germany .
3826676 2/1989 Fed. Rep. of Germany .

OTHER PUBLICATIONS

WAGO Publication.

*Primary Examiner*—Eugene R. LaRoche
*Assistant Examiner*—Michael B. Shingleton
*Attorney, Agent, or Firm*—Jacobson, Price, Holman & Stern

[57] ABSTRACT

A recessed lighting fixture system comprising a power service module which includes sockets for receiving fluorescent light lamps, a ballast for driving each of the light lamps, and a field adjustable connector which is electrically connected to the sockets and the ballasts. The power service module mounts in a mounting frame assembly which is mounted in the ceiling. A primary terminal block is provided in the mounting assembly and is connected to the main power supply. When mounted in the mounting assembly, the field adjustable connector connects to the primary terminal block, thus connecting the light lamps and ballasts to the main power supply. The field adjustable connector is four-pole pre-wired for providing single phase or dual phase power supply to the ballasts of the respective fluorescent light lamps.

15 Claims 6 Drawing Sheets

REMOVABLE POWER SERVICE MODULE FOR RECESSED LIGHTING SYSTEM

BACKGROUND OF THE INVENTION

The present invention relates to a recessed lighting system and more particularly to a power service module which removably fits into a recessed lighting fixture and drives fluorescent light lamps received therein.

Illumination systems for offices and homes have evolved into complex systems which are designed to be sensitive to many human and other environmental factors. Some illumination systems are controlled by microprocessors for changing the level of brightness of lights throughout a room or building.

It is desirable to have the capability to make adjustments to particular light fixtures after the primary control system is wired. Moreover, the need exists to expand design flexibility in systems, such as daylighting and energy conservation systems.

SUMMARY OF THE INVENTION

It is a primary object of the present invention to provide a lighting system which allows for flexibility in the control of power to light lamps in a light fixture.

It is another object of the present invention to provide a recessed lighting fixture having a power service module which removably fits in a ceiling mounted receptacle, receives light lamps, and controls the supply of power to drive the light lamps.

It is still another object of the present invention to provide a recessed lighting fixture comprising an electrical power service module which removably fits into a ceiling mounted receptacle, receives fluorescent light lamps therein and which can be adjusted to control the delivery of power to the light lamps.

Briefly, the present invention is directed to a power service module for use in a ceiling mounted recessed lighting fixture system. The power service module includes sockets for receiving fluorescent light lamps, a ballast for driving each of the light lamps, and a field adjustable connector which is electrically connected to the sockets and the ballasts.

The power service module mounts in a mounting frame assembly which is mounted in the ceiling. A primary terminal block is provided in the mounting frame assembly and is connected to the main power supply. When properly mounted in the mounting frame assembly, the field adjustable connector connects to the primary terminal block, thus connecting the light lamps and ballasts to the main power supply.

The primary terminal block and field adjustable connector are mating parts. The field adjustable connector is four pole pre-wired, for example for providing single phase, dual phase or three phase power supply to the ballasts of the respective fluorescent light lamps. Plug members in the field adjustable connector are removable and adjustable to provide the desired power supply.

The above and other objects and advantages will become more readily apparent when reference is made to the following description taken in conjunction with the accompanying drawings.

DETAILED DESCRIPTION OF THE DRAWINGS

Figure 1:
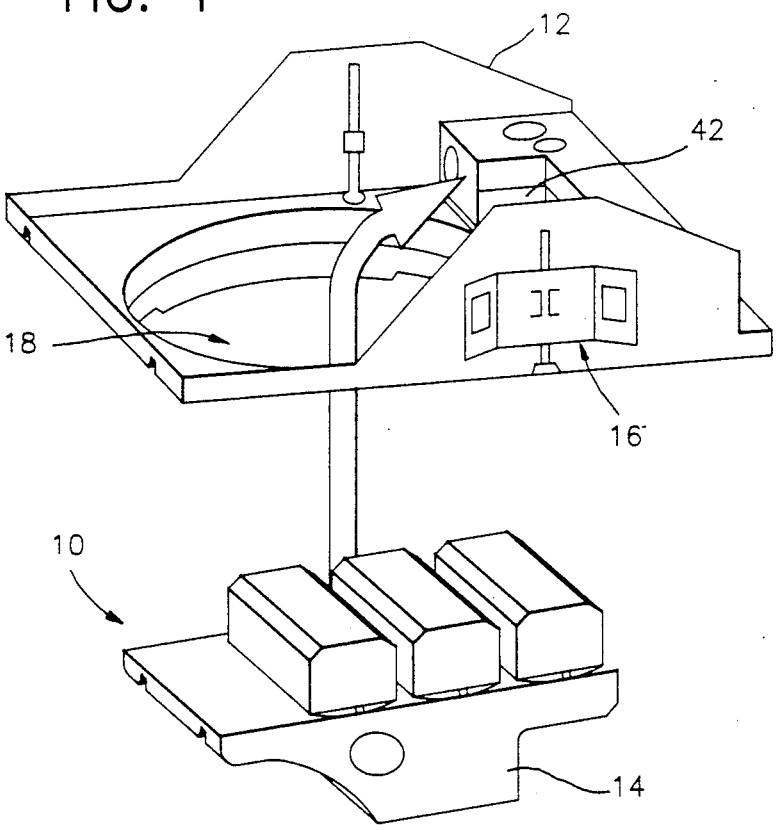
FIG. 1 is a perspective view of the power service module according to the present invention and a mounting pan into which the power service module is mounted.

Referring first to FIG. 1, the power service module is generally shown at 14 as part of a recessed lighting system 10. The recessed lighting system 10 comprises a mounting frame assembly 12 which fits into the ceiling and receives the power service module 14. Adjustable mounting brackets 16 are provided on the lateral sides of the mounting frame assembly 12 to allow for adjustable vertical mounting of the mounting frame assembly 12. The power service module 14 receives fluorescent light lamps (FIGS. 4 and 5) and supplies power to drive the fluorescent light lamps. As is well known in the art, additional hardware such as a reflector, radial parabolic louvers and lucite lenses may be attached to the mounting frame assembly 12 beneath the fluorescent light lamps supported by the power service module 14. As will be explained in more detail hereinafter, the power service module 14 fits into a locked position in the mounting frame assembly 12 through a ceiling aperture 18 of the mounting frame assembly 12.

Figure 2:
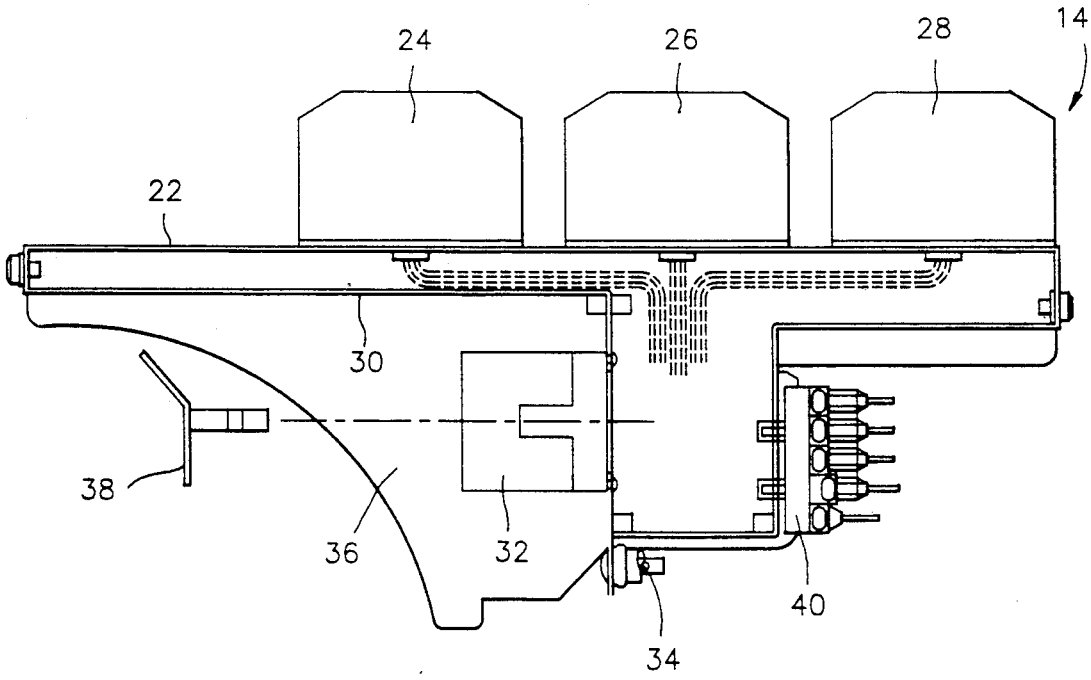
FIG. 2 is a side view of the electrical power service module according to the present invention.

Turning now to FIG. 2, the power service module 14 will be described in greater detail. The power service module 14 comprises a mounting plate 22 supporting thereon three ballasts 24, 26 and 28. A lamp socket holder 30 attaches to the bottom of the mounting plate 22 and supports a lamp socket module 32 for receiving three fluorescent lamps. A snap closure member 34 is provided for connecting the power service module 14 to the mounting frame assembly 12, as will be explained in more detail hereinafter. Side walls 36 are shaped in a semi-parabolic configuration and close the space between the lamp sockets 32 and the mounting plate 22. A plastic cap 38 is provided to fit into each of the sockets of the lamp socket module 32 that are not being used. Secured to the undercarriage portion of the power service module 14 is a field adjustable connector 40 (also referred to as a secondary terminal block). The field adjustable connector 40 is a four-pole plug assembly which is pre-wired and is adjustable for single, dual or three phase circuit arrangements and for integration with a microprocessor-based energy management control system. The ballasts 24, 26 and 28 may be Class "P" NPF Reactor ballasts, rated at 118 V, 60 Hz.

Figure 3B:
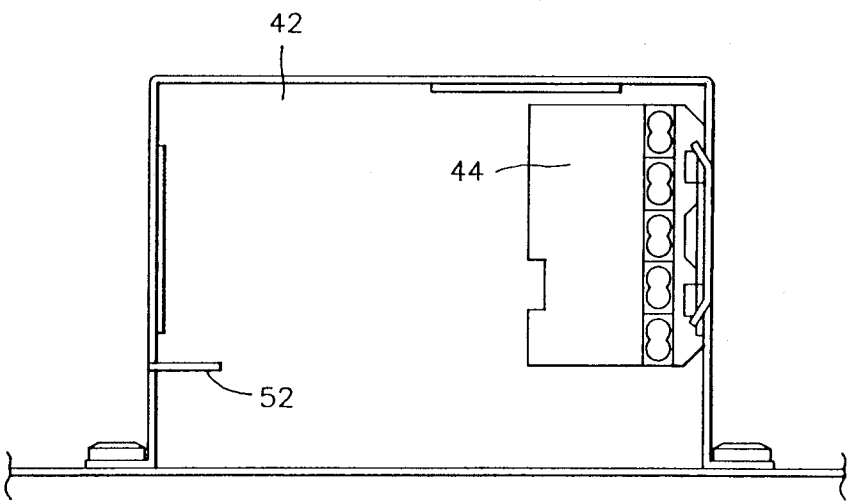
FIGS. 3A and 3B are enlarged side views illustrating mounting of the power service module into the mounting pan.
Figure 3A:
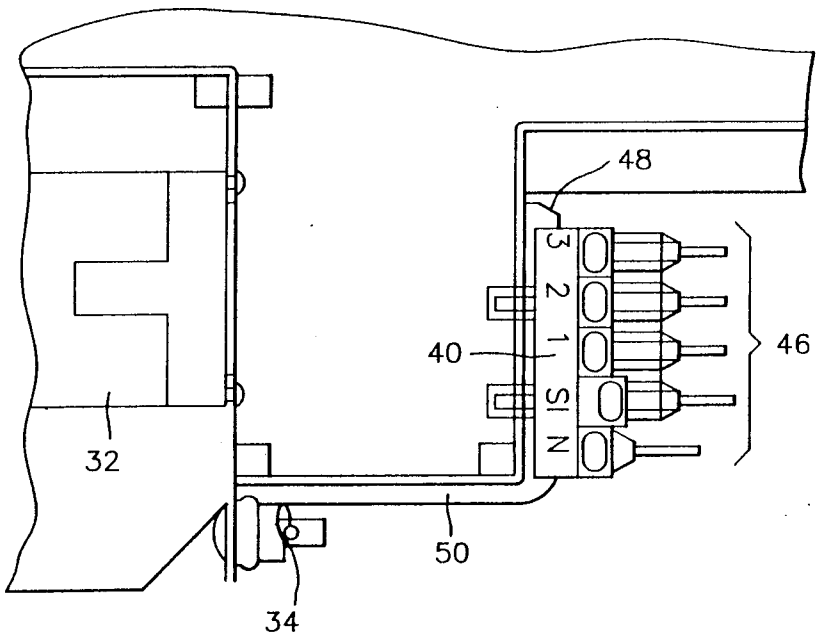

FIGS. 3A and 3B illustrate the attachment of the power service module 14 to the mounting frame assembly 12. The mounting frame assembly 12 comprises a wiring compartment 42 supporting a primary supply terminal block 44. The field adjustable connector 40 of the power service module 14 comprises phase contact plugs 46 designed to mate with and be received by individual terminals (see FIG. 5B) in the primary supply terminal block 44 in the mounting frame assembly 12. The field adjustable connector 40 and the primary supply terminal block 44 are manufactured by WAGO Kontakttechnik GmbH, model Nos. 277-123, 277-124, 277-125 (secondary terminal block 40) and 277-121 and 277-131 (primary terminal block 44). Guide members 48 and 50 are provided on the power service module 14 proximate the field adjustable connector 40. In addition, an alignment member 52 is provided in the wiring compartment 42 to cooperate with the guide member 50. The field adjustable connector 40 is inserted into the wiring compartment 42 to mate with the primary supply terminal block 44. The snap closure member 34 fits around the wall of the wiring compartment 42 to secure the power service module 14 in the mounting frame assembly 12.

Figure 4A:
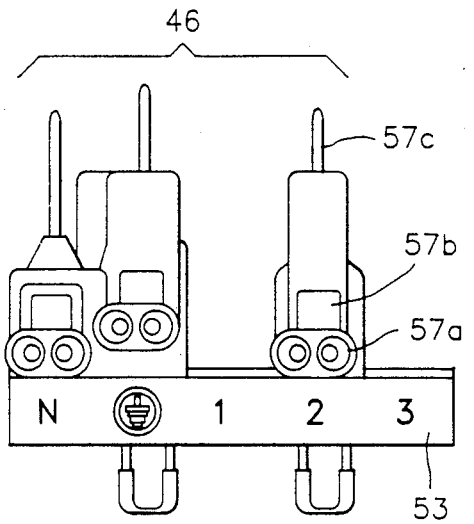
FIGS. 4A and 4B are side views of the secondary supply terminal block mounted on the power service module.
Figure 4B:
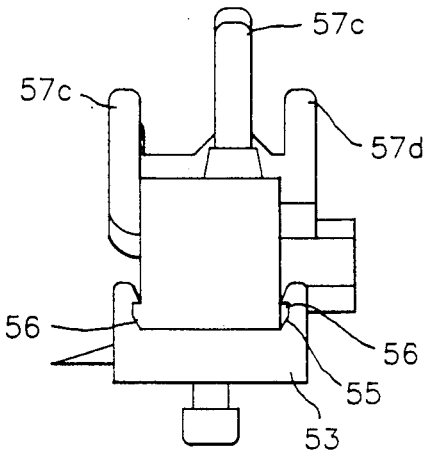

Turning to FIGS. 4A and 4B, the field adjustable connector 40 is shown in detail. It comprises a fixing foot member 53 and a plurality of phase contact plugs 46. The fixing foot member 53 comprises a channel 55 cut therein for receiving the phase contact plugs 46. Each of the phase contact plugs 46 are designed to be removably positioned in the channel 55. Two of the phase contact plugs 46, those for the neutral and ground feed, are designed as a single piece uniquely shaped to prevent incorrect connections. The remaining phase contact plugs 46, those for phase 1, phase 2 and phase 3 feed, are identical in shape. All of the phase contact plugs 46 may be inserted into and removed from the channel 55 to provide for simple adjustment of electrical connections by positioning the phase contact plugs 46 in the position designated by the label on the exterior of the foot member 53. Each phase contact plug 46 has receiving holes 57*a* and a contact terminal 57*b* for connecting with electrical wires, and a terminal pin 57*c*. Also provided on each phase contact plug 46 are plastic plug members 57*d* and 57*d* designed to fit in corresponding channels in the primary supply terminal block 44, as will be described in more detail hereinafter. The power supplied to the ballasts can be controlled by simply inserting a phase contact plug 46 in the appropriate position in the foot member 53 of the field adjustable connector 40. The connections to the ballasts are made to the phase contact plugs 46 before the phase contact plugs 46 are inserted into the foot member 53.

Figure 5A:
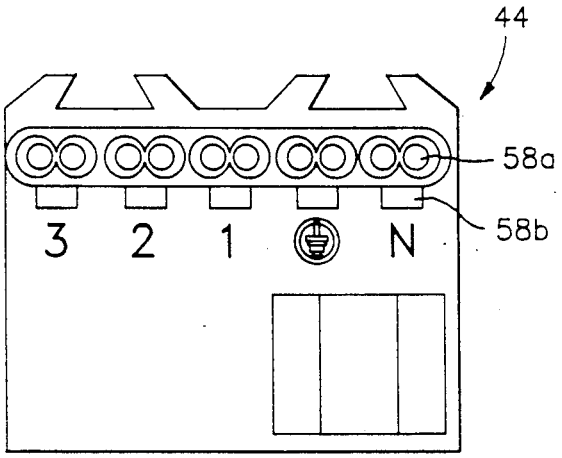
FIG. 5A is a side view of the primary supply terminal block mounted on the mounting pan and which receives the secondary supply terminal block.
Figure 5B:
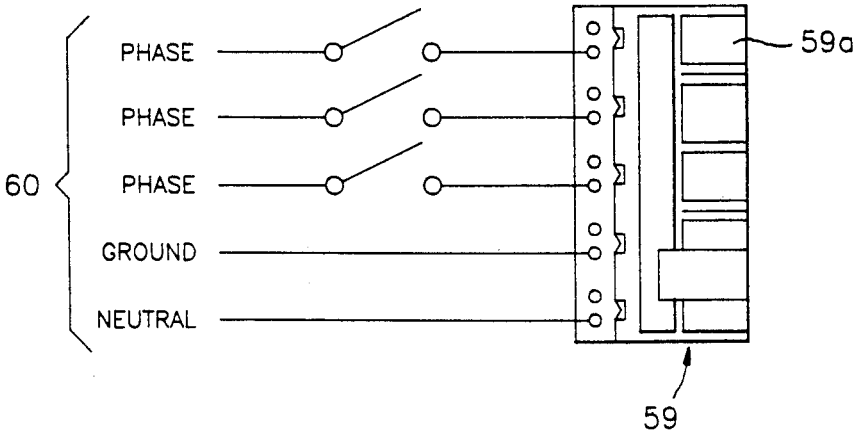
FIG. 5B is a bottom view of the primary supply terminal block.

FIGS. 5A and 5B illustrate the primary supply terminal block 44 in detail. Like the field adjustable connector 40, the primary supply terminal block 44 comprises receiving holes 58*a* and a contact terminal 58*b* for each of the ground, neutral and phase 1-phase 3 terminals, which are so labelled on the exterior of the block 44. As shown in FIG. 5B, a main power supply 60 is appropriately connected to the corresponding ones of the contact terminal 58*b*. The block 44 also comprises an open bottom portion 59 having slots 59*a* designed to receive the plastic plug members 57*c* and 57*d* of the phase contact plugs 46 so as to guide each terminal pin 57*c* into a designated terminal (not shown). Consequently, each phase contact plug 46 is received by its own slot 59*a*, and moreover, the slots are shaped to ensure that only the neutral and ground connections in the field adjustable connector 40 mate with the neutral and ground connections in the primary supply terminal block 44.

Figure 6:
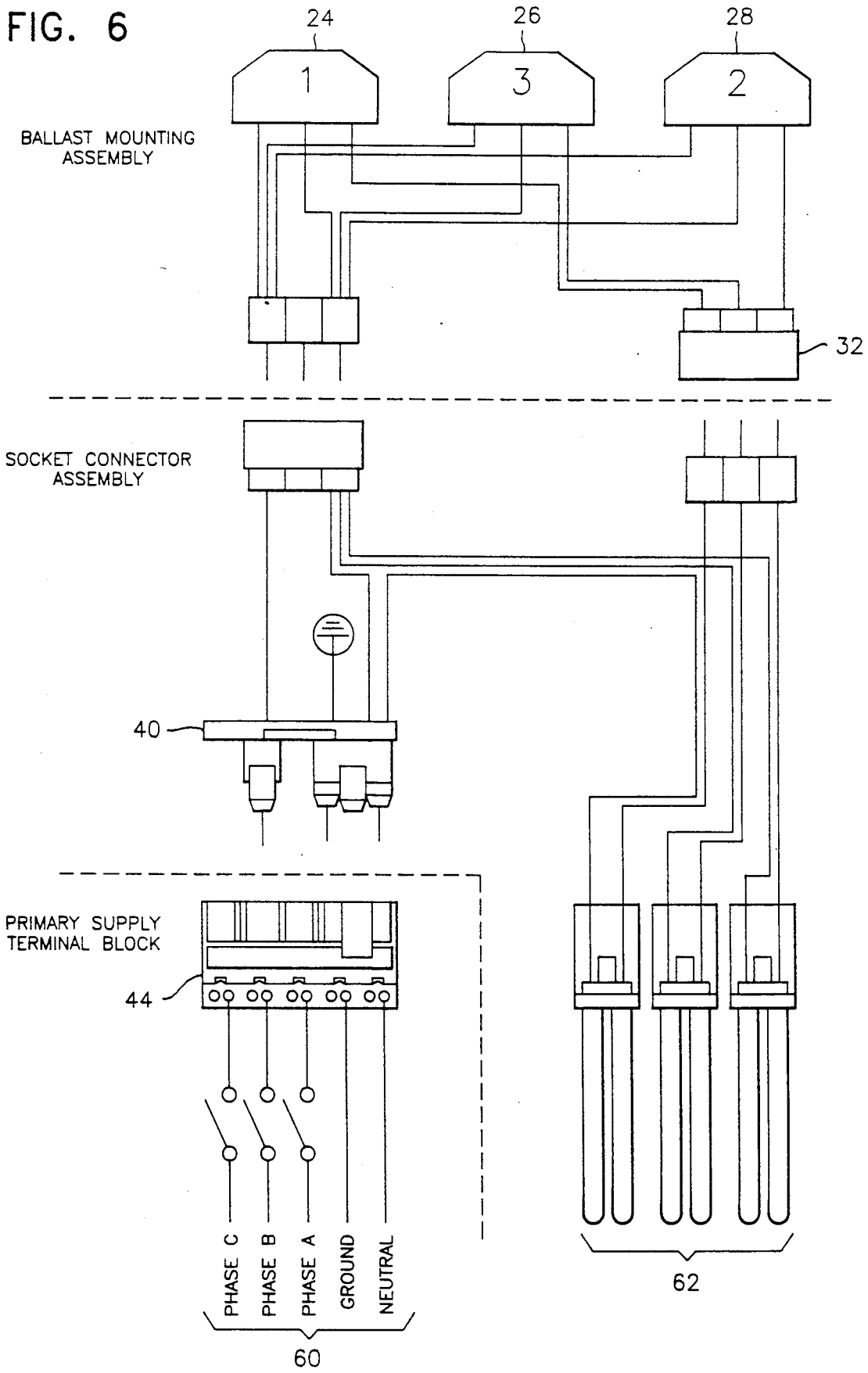
FIGS. 6–8 are diagrams illustrating electrical connections made between the power service module and the mounting pan to effect single phase and multi-phase power supply.
Figure 7:
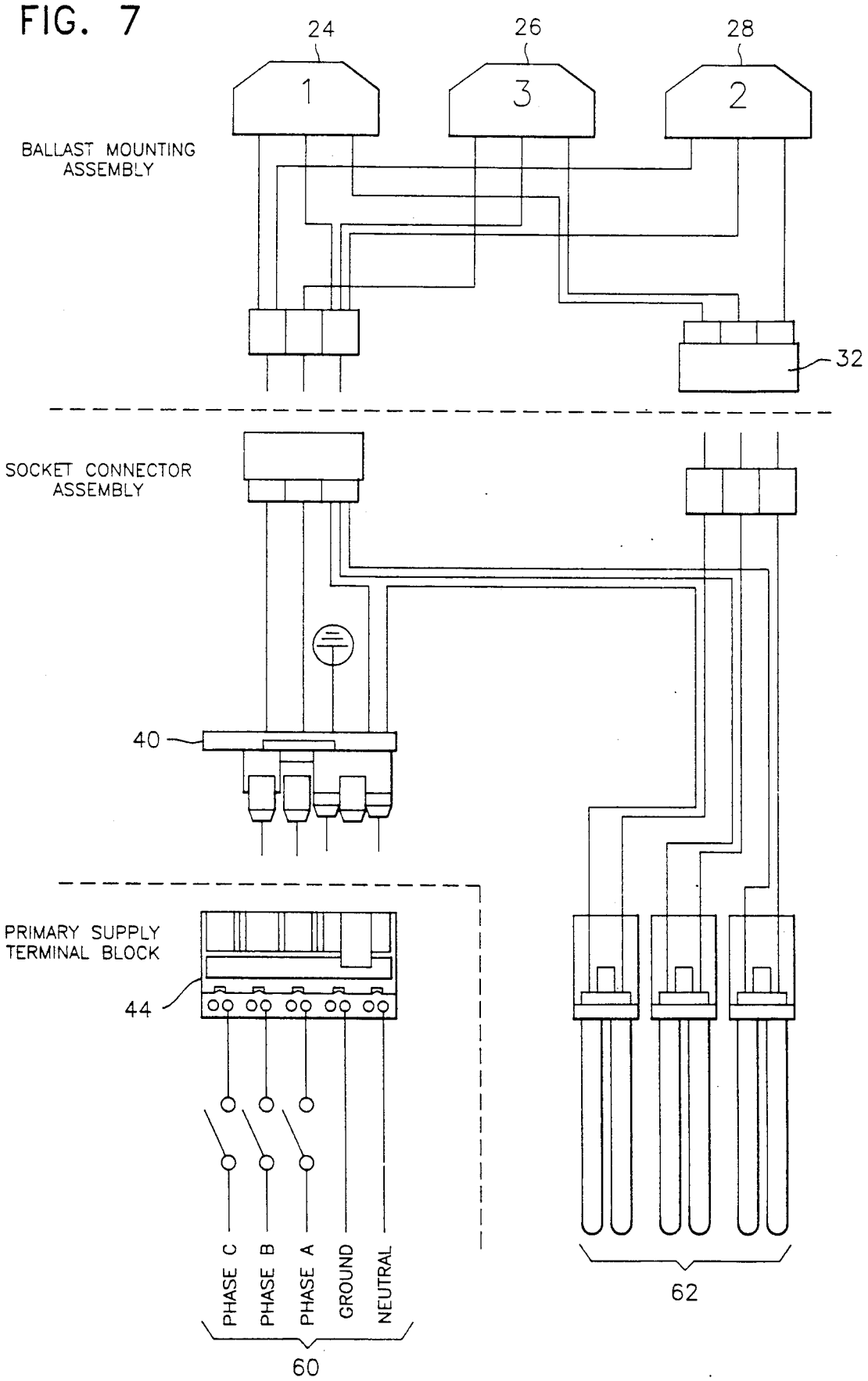
Figure 8:
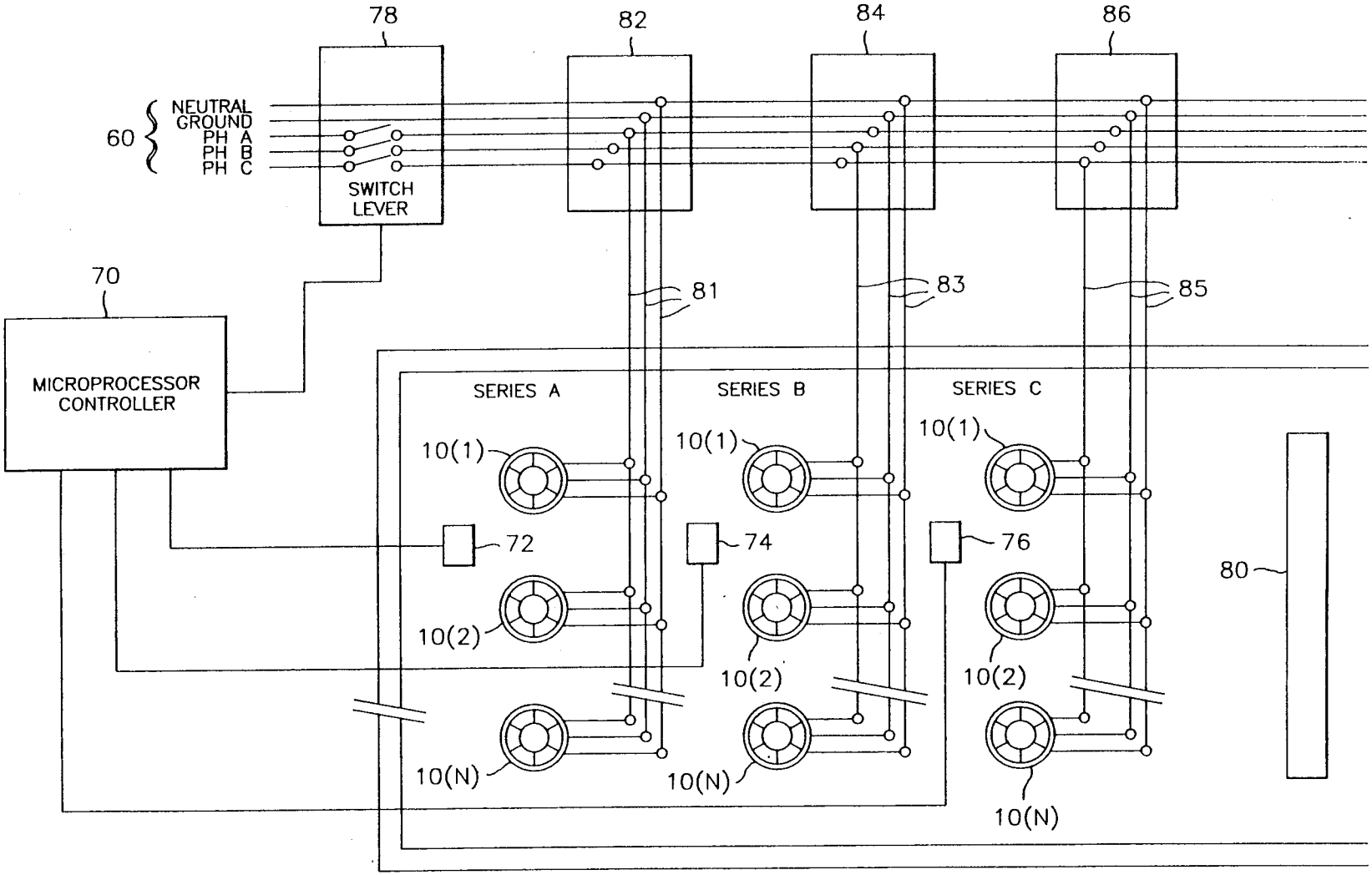

FIGS. 6–8 illustrate various electrical connections which may be effected through the power service module 14 to control the illumination of the fluorescent lamps 62 connected thereto. In each figure, the primary supply terminal block 44 is connected to a main power supply 60 which comprises a neutral wire, a ground wire, and one or more different phases of power supplies. The main power supply 60 may be controlled by a microprocessor-based energy management control system. All of the connections between the ballasts 24, 26 and 28 and the sockets of the corresponding ones of the fluorescent lamps 62 are established internally of the power service module 14 at manufacture. Each of the ballasts 24, 26 and 28 and the fluorescent lamps 62 is also appropriately connected to the field adjustable connector 40.

Specifically, in FIG. 6, a single phase arrangement is shown in which each ballast is connected to the ground and neutral terminals and to one phase power supply terminal. In this manner, each one of the fluorescent light lamps 62 is driven at the same phase by its respective ballast.

In FIG. 7, a double phase arrangement is shown. Each ballast is connected to the ground and neutral terminals. Ballasts 24 and 28 are connected to phase B power supply and ballast 26 is connected to phase A power supply. As a result, two of the fluorescent light lamps 62 (1 and 2) are driven at phase B while one light lamp (3) is driven at phase A.

FIG. 8 illustrates yet another configuration in which multiple power service modules are arranged in groups or series as part of a microprocessor controlled lighting system. For example, three series of recessed light fixtures, each having a plurality of recessed lighting fixtures 10(1)–10(N) are provided. Associated proximate each series is a light sensor 72, 74 and 76. These light sensors 72, 74 and 76 feed their outputs to a microprocessor controller 70, which controls the connection of a main power supply 60 comprising a neutral line, a ground line, power supply line for series A (Ph A), power supply line for series B (Ph B) and power supply line for series C (Ph C). The microprocessor controller 70 controls a switch lever 78, which comprises a switch for each of the power supply lines to series A, B and C. The switches in the switch lever 78 are caused to open or close under control of the microprocessor controller 70. More than one light sensor may be provided for each series of fixtures, for example, proximate each light fixture in a series.

Each of the series A, B and C of the fixtures, are electrically connected to the main power supply lines 60 by established hardwire connections shown at 82, 84 and 86, respectively. Specifically, series A has associated therewith series supply lines 81 which connect to the neutral, ground and Ph A lines by hardwire connection 82; series B has associated therewith series supply lines 83 which connect to the neutral, ground and Ph B lines by hardwire connection 84; and series C has associated therewith series supply lines 85 which connect to the neutral, ground and Ph C lines by hardwire connection 86. Consequently, each fixture in series A receives Ph A power, each fixture in series B receives Ph B power, and so forth.

However, each fixture in each series can be adjustably connected to its respective power supply lines so that a certain one, ones or all of the light lamps in the fixture are connected to the power supply lines, and thus remotely controlled by the microprocessor controller 70. This is accomplished by appropriately connecting the primary terminal block 44 and the field adjustable connector 40 in each fixture as shown in FIGS. 4A, 4B, 5A, 5B and 6. For example in series A, the fixture 10(1) may be configured so that two of the light lamps are connected to the power supply line Ph A while the other is not. These may be the outside two lamps or any other combination of lamps in the fixture. Moreover, each fixture may support any number of lamps.

One application of the configuration shown in FIG. 8 is to coordinate lighting in a room in which the series A, B and C of recessed lighting fixtures are positioned with series C being closest to a window 80. A desired lighting condition can be achieved in each position of a room proximate a lighting fixture 10. Light sensors 72, 74 and 76 detect the level of light proximate each series. According to the amount of light given off by each fixture and the amount of sunlight which reaches various regions in the room through the window 80, the microprocessor controller 70 causes the switch lever 78 to close or open one or more of its switches to cut-off or supply power to a series of fixtures. The microprocessor is programmed to achieve the desired lighting condition and on this basis controls the switch lever 78. Such a configuration can be used to maintain a substantially uniform level of lighting throughout a room at all times or to achieve predetermined lighting levels in a particular regions of the room at all times.

The above description is intended by way of example only and is not intended to limit the present invention in any way except as set forth in the following claims.

We claim:

1. A power service module for use in a recessed lighting fixture system comprising:

a plurality of ballasts;

support means for supporting said plurality of ballasts;

socket means for receiving a plurality of fluorescent light lamps, each to be driven by a respective one of the plurality of ballasts;

terminal block means electrically connected to said socket means and to said plurality of ballasts, said terminal block means for electrical connection to a main power supply and being adjustable so as to provide single phase power from the main power supply to said plurality of ballasts and also adjustable so as to provide multi-phase power from the main power supply to said plurality of ballasts.

2. The module of claim 1, wherein said terminal block means comprises a plurality of phase contact plugs adjustable so as to connect each of said plurality of ballasts to said main power supply in a single phase configuration and also adjustable so as to connect each of said plurality of ballasts to said main power supply in a multi-phase configuration.

3. In a recessed lighting fixture system comprising a mounting frame assembly which fits into the ceiling and includes a primary terminal block electrically connected to a main power supply, the improvement comprising:

a power service module having a plurality of ballasts, support means for supporting said plurality of ballasts, socket means for receiving a plurality of fluorescent light lamps, each to be driven by a respective one of said plurality of ballasts, a field adjustable connector electrically connected to each of said plurality of ballasts and to said socket means, said power service module being removably mounted in said mounting frame assembly with said field adjustable connector mating with the primary terminal block for connecting said plurality of ballasts to said main power supply, wherein said field adjustable connector is adjustable so as to supply single phase power from the main power supply to said plurality of fluorescent light lamps and is also adjustable so as to supply multi-phase power from the main power supply to said plurality of fluorescent light lamps.

4. The improvement of claim 3, wherein said field adjustable connector comprises a plurality of phase contact plugs and said primary terminal block comprises a plurality of terminal members which receive said plurality of phase contact plugs, said phase contact plugs being adjustable in said field adjustable connector so as to connect each of said plurality of ballasts to said main power supply in a single phase configuration and adjustable so as to connect each of said plurality of ballasts to said main power supply in a multi-phase configuration.

5. In combination, a mounting frame assembly which fits into the ceiling and includes a primary terminal block electrically connected to a main power supply, and a power service module having a plurality of ballasts, support means for supporting said plurality of ballasts, socket means for receiving a plurality of fluorescent light lamps, each to be driven by a respective one of said plurality of ballasts, field adjustable connector means electrically connected to each of said plurality of ballasts and to said socket means, said power service module being removably mounted in said mounting frame assembly with said field adjustable connector mating with the primary terminal block for connecting said plurality of ballasts to said main power supply, wherein said field adjustable connector block is adjustable so as to supply single phase power from the main power supply to said plurality of fluorescent light lamps and is also adjustable so as to supply multi-phase power from the main power supply to said plurality of fluorescent light lamps.

6. The combination of claim 5, wherein said field adjustable connector comprises a plurality of phase contact plugs and said primary terminal block comprises a plurality of terminal members which receive said plurality of phase contact plugs, said phase contact plugs being adjustable in said field adjustable connector so as to connect each of said plurality of ballasts to said main power supply in a single phase configuration and also adjustable in said field adjustable connector so as to connect each of said plurality of ballasts to said main power supply in a multi-phase configuration.

7. A microprocessor controlled recessed lighting fixture system comprising:

a microprocessor-based energy management system for supplying electrical energy to drive a plurality of fluorescent light lamp fixtures;

a plurality of fluorescent light lamp fixtures each comprising a mounting frame assembly which fits into the ceiling and includes a primary terminal block electrically connected to a main power supply, and a power service module having a plurality of ballasts, support means for supporting said plurality of ballasts, socket means for receiving a plurality of fluorescent light lamps, each to be driven by a respective one of said plurality of ballasts, a field adjustable connector electrically connected to each of said plurality of ballasts and to said socket means, said power service module being removably mounted in said mounting frame assembly with said field adjustable connector mating with the primary terminal block for connecting said plurality of ballasts to said main power supply, wherein said field adjustable connector is adjustable so as to supply single phase power from the main power supply to said plurality of fluorescent light lamps and is also adjustable so as to supply multi-phase power from the main power supply to said plurality of fluorescent light lamps.

8. The system of claim 7, wherein said field adjustable connector comprises a plurality of phase contact plugs and said primary terminal block comprises a plurality of terminal members which receive said plurality of phase contact plugs, said phase contact plugs being adjustable in said field adjustable connector so as to connect each of said plurality of ballasts to said main power supply in a single phase configuration and also adjustable in said field adjustable connector so as to connect each of said plurality of ballasts to said main power supply in a multi-phase configuration.

9. A method for controlling overall lighting on-site of a recessed fluorescent light fixture system without rewiring basic supply connections, the method comprising the steps of:

securing a mounting frame assembly into the ceiling, said mounting frame assembly including a primary terminal block electrically connected to a main power supply;

providing a power service module having a plurality of ballasts, support means for supporting said plurality of ballasts, socket means for receiving a plurality of fluorescent light lamps, each to be driven by a respective one of said plurality of ballasts, field adjustable connector means having a plurality of contact plugs, said field adjustable connector means being electrically connected to each of said plurality of ballasts and to said socket means;

adjusting said contact plugs in said field adjustable connector means for electrical connection with said plurality of ballasts according to a selectively chosen one of a plurality of possible lighting configurations so as to control which of said plurality of ballasts selectively receives power from said main power supply;

removably mounting said power service module in said mounting frame assembly with said field adjustable connector means mating with the primary terminal block for connecting said plurality of ballasts to said main power supply.

10. A system for controlling light emitted by a plurality of light fixtures comprising:

a plurality of series of said light fixtures;

light sensor means positioned proximate each of said series of said light fixtures for detecting the level of light proximate thereto and providing an electrical signal representative thereof;

microprocessor controller means connected and responsive to said light sensor means, for providing a plurality of switch control signals, each of said switch control signals corresponding to a particular one of said series of said light fixtures and being indicative of whether power is to be supplied to said particular one of said series of said light fixtures in order to maintain a desired lighting level about said particular one of said series of said light fixtures;

main power supply lines for carrying a plurality of power supply signals;

switch means connected in series with said main power supply lines and responsive to said switch control signals for opening or closing the main power supply lines for a particular one or ones of the power supply signals;

a plurality of sets of series supply lines dedicated to a particular series of said series of said light fixtures, each of said sets of series supply lines dedicated to said series of said light fixtures being connected to corresponding ones of the main power supply lines; and wherein each of said light fixtures comprises:

socket means for receiving a plurality of light lamps;

driving means connected to said socket means for driving each of the light lamps received in said socket means to cause the light lamps to illuminate;

adjustable connection means connected to said means for driving and said socket means for connecting the light fixture to the corresponding series supply line to provide power to a select one or ones of the light lamps received in the socket means of the light fixture.

11. The system of claim 10, wherein said adjustable connection means comprises:

a primary terminal block electrically connected to said corresponding series supply line;

a field adjustable connector electrically connected to said driving means and said socket means and being adjustable so as to power a select one or ones of said light lamps received in said socket means by a corresponding one of said plurality of power supply signals.

12. The system of claim 11, wherein said field adjustable connector comprises a plurality of phase contact plugs and said primary terminal block comprises a plurality of terminal members which receive said plurality of phase contact plugs, said phase contact plugs being adjustable in said field adjustable connector so as to connect said select one or ones of said light lamps to said corresponding one of said plurality of power supply signals.

13. A power service module for a recessed lighting fixture, said power service module comprising:

a plurality of ballasts;

support means for supporting said plurality of ballasts;

socket means for receiving a plurality of fluorescent light lamps, each to be driven by a respective one of the plurality of ballasts; and terminal block means electrically connected to said socket means, and to said plurality of ballasts, said terminal block means being adjustable so as to selectively make electrical contact with a predetermined one or ones of said plurality of ballasts to thereby select which one or ones of said plurality of light lamps receive power from said main power supply.

14. A recessed lighting fixture comprising:

a mounting frame assembly which permanently fits into a ceiling and includes a primary terminal block electrically connected to a main power supply;

a removable power service module comprising a plurality of ballasts; support means for supporting said plurality of ballasts; socket means for receiving a plurality of fluorescent light lamps, each to be driven by a respective one of the plurality of ballasts; and terminal block means electrically connected to said socket means, and to said plurality of ballasts, said terminal block means being adjustable so as to selectively make electrical contact between said main power supply and a predetermined one or ones of said plurality of ballasts to thereby select which one or ones of said plurality of light lamps receive power from said main power supply; and mounting means to mount said power service module in said mounting frame assembly thereby electrically connecting a select one or ones of said plurality of ballasts to said main power supply based upon the configuration of said terminal block means.

15. A microprocessor controlled recessed lighting fixture system comprising a microprocessor-based energy management system for supplying electrical energy to drive a plurality of fluorescent light lamp fixtures, and a plurality of fluorescent light lamp fixtures each of which comprises:

a mounting frame assembly which permanently fits into the ceiling and includes a primary terminal block electrically connected to a main power supply; and a power service module removably mounted in said mounting frame assembly, said power service module having a plurality of ballasts, support means for supporting said plurality of ballasts, socket means for receiving a plurality of fluorescent light lamps, each to be driven by a respective one of said plurality of ballasts, and a field adjustable connector electrically connected to said plurality of ballasts and to said socket means, said field adjustable connector mating with the primary terminal block and being adjustable so as to selectively make electrical contact between said main power supply and a predetermined one or ones of said plurality of ballasts to thereby select which one or ones of said plurality of fluorescent light lamps receive power from said main power supply.

* * * * *